US006520485B1

(12) United States Patent
Soot

(10) Patent No.: US 6,520,485 B1
(45) Date of Patent: Feb. 18, 2003

(54) WINCH SYSTEM FOR RAISING AND LOWERING THEATRE SCENERY

(76) Inventor: Olaf Soot, 9 Tomahawk La., Greenwich, CT (US) 06830

( * ) Notice: Subject to any disclaimer, the term of this patent is extended or adjusted under 35 U.S.C. 154(b) by 244 days.

(21) Appl. No.: 09/690,116

(22) Filed: Oct. 13, 2000

(51) Int. Cl.[7] ..... B66D 1/00

(52) U.S. Cl. ..... 254/331; 160/331; 160/344

(58) Field of Search ..... 254/329, 331, 254/338, 378, 388, 389; 160/331, 344, 143

(56) References Cited

U.S. PATENT DOCUMENTS 977,499 A * 12/1910 Bailey ..... 160/331
977,500 A * 12/1910 Bailey ..... 160/331
1,263,628 A * 4/1918 Vallen ..... 160/331
1,340,066 A * 5/1920 Lemle ..... 160/331
1,821,563 A * 9/1931 Mitchell et al. ..... 188/70 R
2,649,279 A * 8/1953 Jones et al. ..... 254/329
4,251,059 A * 2/1981 Fougea ..... 254/266
4,324,386 A 4/1982 Gagnon et al.
4,662,628 A 5/1987 Chatenay
5,031,574 A * 7/1991 McDowell ..... 119/448
5,361,565 A * 11/1994 Bayer ..... 254/270
6,364,062 B1 * 4/2002 Ericson et al. ..... 187/264

* cited by examiner

*Primary Examiner*—Emmanuel Marcelo

(57) ABSTRACT

A motorized fly system winch, drum and carriage combination for raising and lowering, for example, theatre scenery by means of cables and which incorporates functions for emergency braking, for moving the drum in synchronization with relation to the carriage containing cable-guiding means and for driving of a limit switch if desired. The winding and unwinding the cables on or off the drum does not change the cable runs relative to the theatre. The fly system winch can be installed at the sides of the stage, up at the stage gridiron, or above the gridiron. With this combination, counterweights are unnecesary. The fly system winch is compact and can be economically manufactured.

33 Claims, 14 Drawing Sheets

WINCH SYSTEM FOR RAISING AND LOWERING THEATRE SCENERY

This invention is based on Disclosure Document No 474944, filed May 30, 2000.

This invention is directed to raising and lowering objects, in particular, objects such as theater scenic elements, suspended from fly sets, by failsafe motorized means.

BACKGROUND OF INVENTION

Most of the present-day fly systems in theaters are manually operated counterweight sets. Each counterweight set consists essentially of one pipe batten, somewhat longer than the width of the proscenium opening, suspended by lines or cables, such as wire ropes, which are spaced approximately 8–10 ft apart along its length. Each wire rope passes from the suspended pipe batten over a sheave or loftblock, which is either mounted on the stage gridiron or underhung from the stagehouse roof beam. From the loftblocks all lines lead to a common headblock, mounted at one side of the stage and pass over it down to a counterweight arbor. The counterweight arbor is typically a steel frame, supporting lead, cast iron or steel weights. Counterweight arbors are guided by tee tracks, mounted on the stage side wall.

An operating rope is tied to the top of each counterweight arbor. From there it goes up and over the headblock, then down and around a rope tension sheave, (which is located below the counterweight usually at stage floor height) and up again where it is connected to the bottom of the counterweight arbor. The operating rope also passes through a friction type rope lock, which holds the nearly balanced pipe batten and counterweight arbor in position. The pipe battens are usually spaced six inches on center, parallel to the proscenium opening, and are sometimes spaced even closer. Wider spacing is used in smaller theaters. The number of fly sets in theaters varies. A small high school theater may have only 20–25, whereas more than 100 may be used in large theaters.

These known systems have disadvantages. Loading and unloading counterweights for balancing the loads suspended by the pipe battens is time consuming and dangerous. The loading and unloading of weights usually happens when the batten is at stage level and the counterweight arbor is at gridiron level. There have been numerous accidents when counterweights were dropped from 60–70 feet above the stage onto people standing below operating other counterweight sets. In case of unbalance, the pipe batten and counterweight may run away when the rope lock is opened.

While some motorized winches have been used in larger theaters, they are expensive and often not affordable for smaller theaters.

BRIEF SUMMARY OF INVENTION

An object of the present invention is a motorized failsafe fly system winch that can be substituted for the manually operated counterweight set Anther object of the present invention is a motorized failsafe fly system winch that is compact and can be economically manufactured.

A further object of the present invention is a motorized failsafe fly system winch which does not require counterweights and which permits elimination and simplification of several parts, normally used for similar winches, without sacrificing the functioning.

Yet another object of the invention is a movable winch drum and carriage combination for raising and lowering theatre scenery which incorporates functions for emergency braking, for moving the drum (and its support base) in synchronization with relation to the carriage and for driving of a limit switch if desired.

A still further object of the present invention is a motorized failsafe fly system winch which is compact and sufficiently versatile that it can easily be adapted for mounting along the theatre side walls or to a gridiron or to the ceiling.

The various features of novelty which characterize the invention are pointed out with particularity in the claims annexed to and forming a part of of this disclosure. For a better understanding of the invention, its operating advantages and specific objects attained by its use, reference should be had to the accompanying drawings and descriptive matter in which there are illustrated and described the preferred embodiments of the invention, and in which like reference numerals denote the same or similar components.

DETAILED DESCRIPTION OF PREFERRED EMBODIMENTS

As used in this application, a "flyset" typically is the combination of a batten, loft blocks (sheaves) and one or more support lines, for example, a wire cable or rope, attached to the batten and engaging a loft block. Typically, the number of loft blocks equals the number of support lines. A "batten" is the structural member typically supporting a scenic element. Typically the batten is a steel pipe, though other strip-type structural members can be substituted. When the scenery to be raised and lowered is, for example, a screen or backdrop extending laterally across the stage, the supporting batten typically has a length exceeding the width of the proscenium, i.e., the stage opening visible to the audience, and the batten would typically use 4–7 support lines spaced evenly across its top. As used herein, the terms "laterally: and "width" refer to the horizontal dimension or direction of the proscenium, and the term "vertically" refers to the vertical dimension or direction of the proscenium. The "stage ceiling" is the ceiling of the stage tower that is above and behind the open curtain and not visible to the audience. It typically extends, when the scenery is lifted straight up and removed from the view of the audience, to a distance above the top of the proscenium equal to or greater than the height of the scenery. The term "gridiron" refers to a rigid structural member typically composed of steel beams that forms an open grid structure extending parallel to and typically 6–7 feet below the stage ceiling out of view of the audience and which is capable of supporting various objects. "Wells" in the gridiron are larger openings through which support wires can be extended to battens or other structures beneath.

In a preferred embodiment, the invention is directed to a movable winch drum and carriage combination for raising and lowering objects such as theatre scenery and which incorporates functions for emergency braking, for moving the drum in synchronization with relation to a carriage and for driving of a limit switch. The winding and unwinding of the cables on or off the drum does not change the orientation of the cables relative to the facility or theatre. What this means is that the scenery typically moves vertically and not horizontally.

Figure 1:
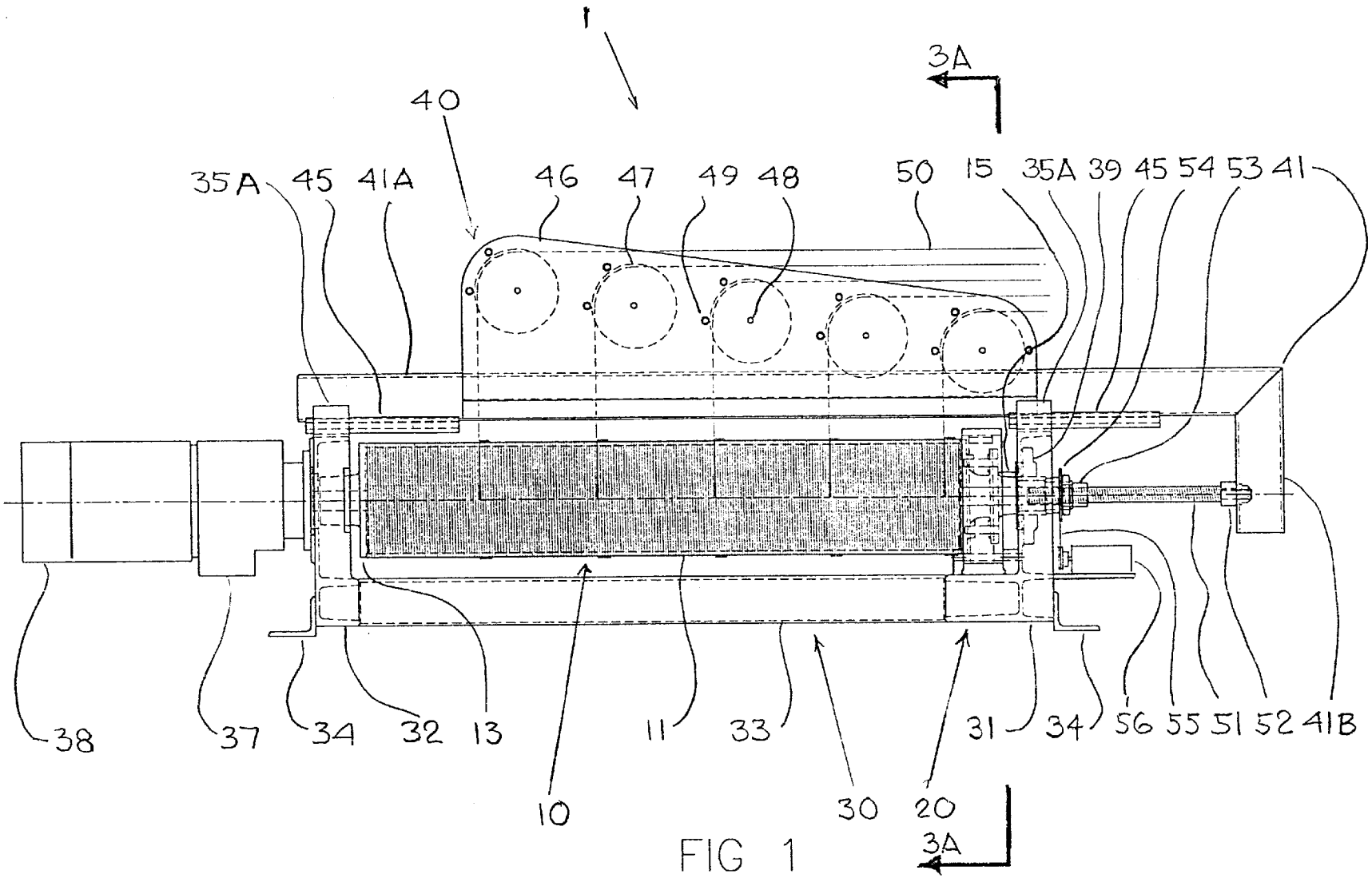
FIG. 1 is a side view of a fly system winch in accordance with the invention, shown in one configuration, with the base and drum assembly ready for mounting to a facility structure.
Figure 2:
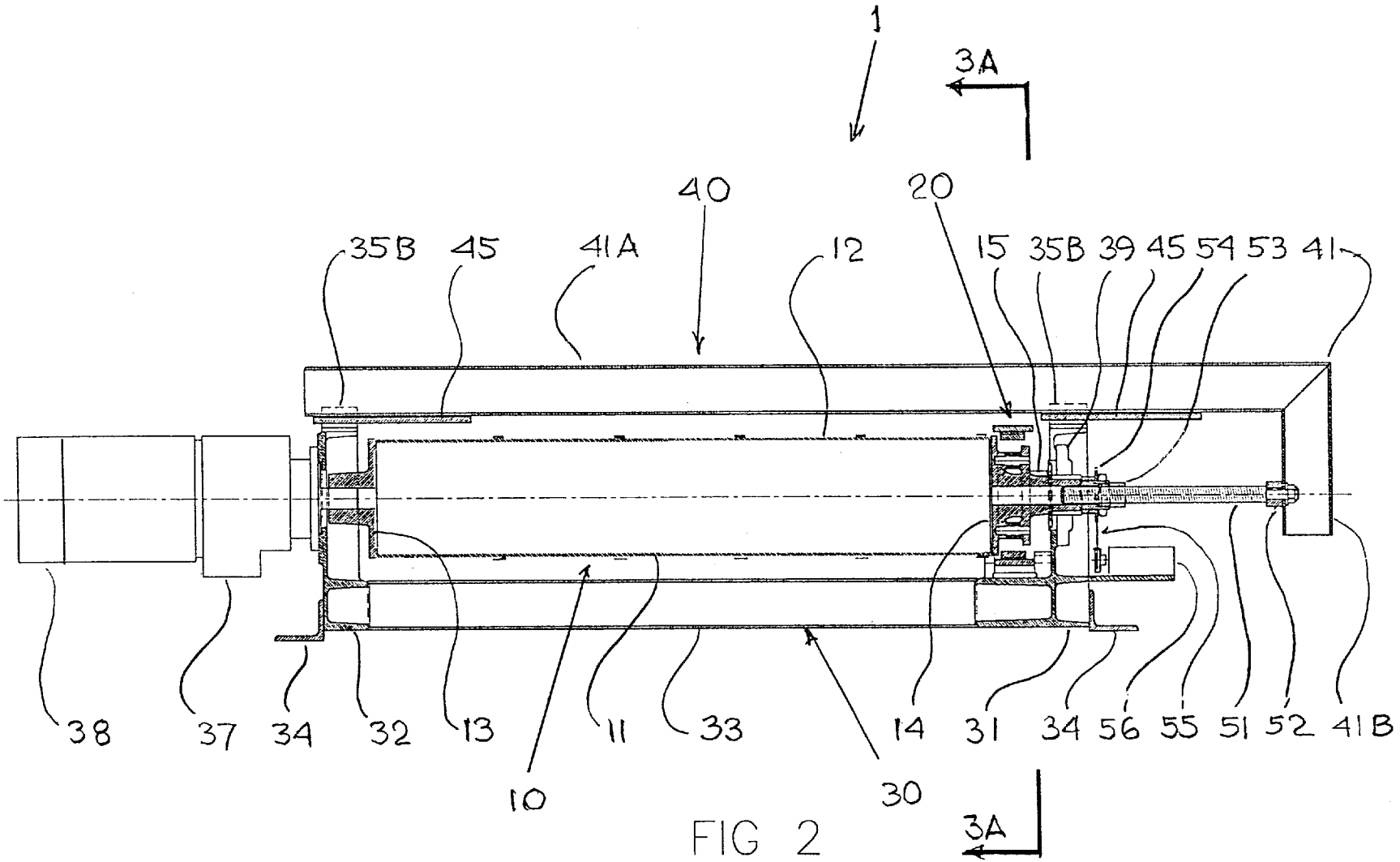
FIG. 2 is a longitudinal cross section of the fly system winch in the same configuration as shown on FIG. 1.

One form of fly system winch according to the invention is designated 1 in FIG. 1 and FIG. 2 (a longitudinal cross section of FIG. 1). It includes a drum assembly 10 comprising a multi-line grooved cable drum 11, rotatably-supported and directly driven at one end through a motorized gear reducer 37 and supported at the other end by an anti-friction bearing 39. The anti-friction bearing 39 and the motorized gear reducer 37 are mounted on a base 30. The cable drum II is supported from bearing 39 by an elongated hub, part of the cable drum 11 brake end cap 14. The cable drum brake end cap 14 also forms the housing for parts of an overspeed brake 20, which would engage in case of overspeed drum rotation, if caused by the motorized gear reducer 37 or a motor brake 38 failure. Under normal conditions, the load on the winch 1 is held by the motor or by the motor brake 38, which is part of the motorized gear reducer 37. All the above components, i.e., the drum, the drum supports and bearings, and the electrical driver (the motorized gear reducer), are mounted on base 30.

A carriage 40, with sheave housing 46 and plural sheaves 47, is slideably mounted via slides 45 on a frame 41 of the base 30, through linear bearings 35A and 35B (FIG. 3) engaging the slides 45. Plural cables 50 pass from the drum 11 over their respective vertically and horizontally offset cable-guiding sheaves 47, over respective loftblocks 63 (as shown on FIG. 9) to a pipe batten 64, used for supporting the stage sets. In the configuration shown in FIG. 1 and FIG. 2, the drum assembly 10 is mounted on base 30, and base 30 is mounted to the facility structure (not shown in FIG. 1) by means of mounting legs 34. When the rotating drum 11 winds or unwinds the cables in the set of grooves, the cables 50 travel back or forth in the drum 11 grooves. Therefore, in order to provide straight cable runs between the horizontally-fixed drum assembly 11 and sheaves 47, the carriage 40, together with the sheaves 47, has to travel laterally (parallel to the drum axis) in synchronization with and in the same direction as the cable back and forth travel in the drum 11 grooves. By a "straight cable run" is meant that the angular orientation between the drum and the cable-guiding sheaves is maintained, sometimes referred to as "zero fleet angle". So, for example, when the winch is mounted horizontally, the cables are maintained in a vertical orientation, and when the winch is mounted vertically, the cables are maintained in a horizontal orientation. If mounted at an angle, then the cable angular orientation is maintained.

A feature of this invention is that the cable drum assembly 10 is used for horizontally moving the carriage 40 together with its attached sheaves 47, in relation to base 30, which is fixed, in synchronization with the cable 50 back and forth travel in the drum 11 grooves. This is accomplished, in accordance with a preferred embodiment of the invention, by an ACME (or ball) screw 51, connected non-rotatably to frame 41 of carriage 40 by a fixture 52. A nut 53 is non-rotatably mounted to the drum assembly 10 brake end cap 14 elongated hub, which hub is hollow so that the screw 51 can pass, via the hollow hub, inside the drum 11, which is also hollow, where the screw 51 is protected when the pipe batten with its attached scenery, hung from winch 1, is in its up or storage position. The view in FIG. 1 with the screw 51 extending outside the drum occurs when the scenery is in its down position. Storing the screw 51 inside the hollow drum 11 is possible because the drum is not mounted on a separate shaft but the drum itself forms its own shaft. Another advantage of this construction is that it also reduces the overall length (its long dimension) of the winch 1. Still further, another advantage is that the overspeed braking can be implemented with the larger diameter hub, which is less prone to fatigue and other failures than a smaller diameter shaft if the latter were used. The nut 53, being secured to the hub, rotates together with the drum assembly and also with respect to the screw 51. The pitch of the screw 51 thread is equal to the pitch of the drum 11 cable grooves. Therefore, the carriage 40 is moved in synchronization with the back or forth travel of the cables 50 in the drum 11 grooves. Straight cable paths are thus maintained between the drum 11 and cable-guiding sheaves 47.

It will also be understood that, if the object to be raised is stored below the stage, its storage position, with the winch mounted above the stage, then it would be preferred to store the screw in the drum when the cable is unwound from the drum.

A sprocket 54 can also be readily mounted on the cable drum 11 brake end cap 14 for driving a limit switch 56 through a chain 55. An encoder (not shown) can also be mounted into the limit switch 56 or in the motorized gear reducer. This construction can be used to limit the axial movement of the drum relative to the frame 41, as well as used to establish the up and down limits of the travel, in-between limits of the travel, and to sense the speed.

Looking now at FIG. 2, the grooved cable drum 11 can be constructed of one tubular member 12, one drive end cap 13 and one brake end cap 14, all welded together. One suitable material for the cable drum would be aluminum. The end caps 13 and 14 can be castings and would incorporate all the weld preps and interfacing details as part of their geometry. The drive end cap 13 supports one end of the drum 11 from the motorized gear reducer 37. A brake 20 and end cap 14 support the other end of drum 11, using the anti-friction bearing 39, thus no separate shaft is required for supporting and rotating the drum 11. Other materials than aluminum can be used for the drum 11. Likewise one-piece construction of the drum 11 is possible while maintaining the functional features described herein.

The base 30 can comprise one horizontal member 33, brake end vertical member 31 and drive end vertical member 32. The brake end vertical member 31 and drive end vertical member can be aluminum castings, incorporating all mounting interfaces for motorized gear reducer 37, anti-friction bearing 39, overspeed brake 20 and outer ring 26, and linear bearings 35A and 35B. An additional roller assembly (not shown) can be mounted on the base 30, if required, for preventing the cables from jumping the drum 11 grooves. This roller assembly can be spring loaded and may incorporate sensors.

The vertical members 31 and 32 incorporate the geometry for all weld preparations necessary for welding them to the horizontal member 33, which can be made of aluminum tubing. The mounting legs 34 can be fastened to the base 30 for mounting it to the facility structure. While aluminum construction is described herein, other materials and other means for constructing the base 30, or connecting its components to each other, can be used.

As shown on FIG. 1 the carriage 40 frame 41 is L-shaped comprising a horizontal member 41A and a vertical member 41B. The sheave housing 46 is mounted at one side of the carriage 40. The sheaves 47 are rotatably mounted into sheave housing 46 through bearings and shafts 48. Spacers 49 can be used to tie the two sides of the sheave housing 46 together for increased stability and to prevent the cables 50 from jumping the sheave grooves. The carriage 40 is slideably connected to base 30 through slides 45, which are rigidly fastened to the frame 41. The slides 45 engage linear bearings 35A and 35B, mounted into the top portions of the base 30 vertical members 31 and 32.

Figure 3:
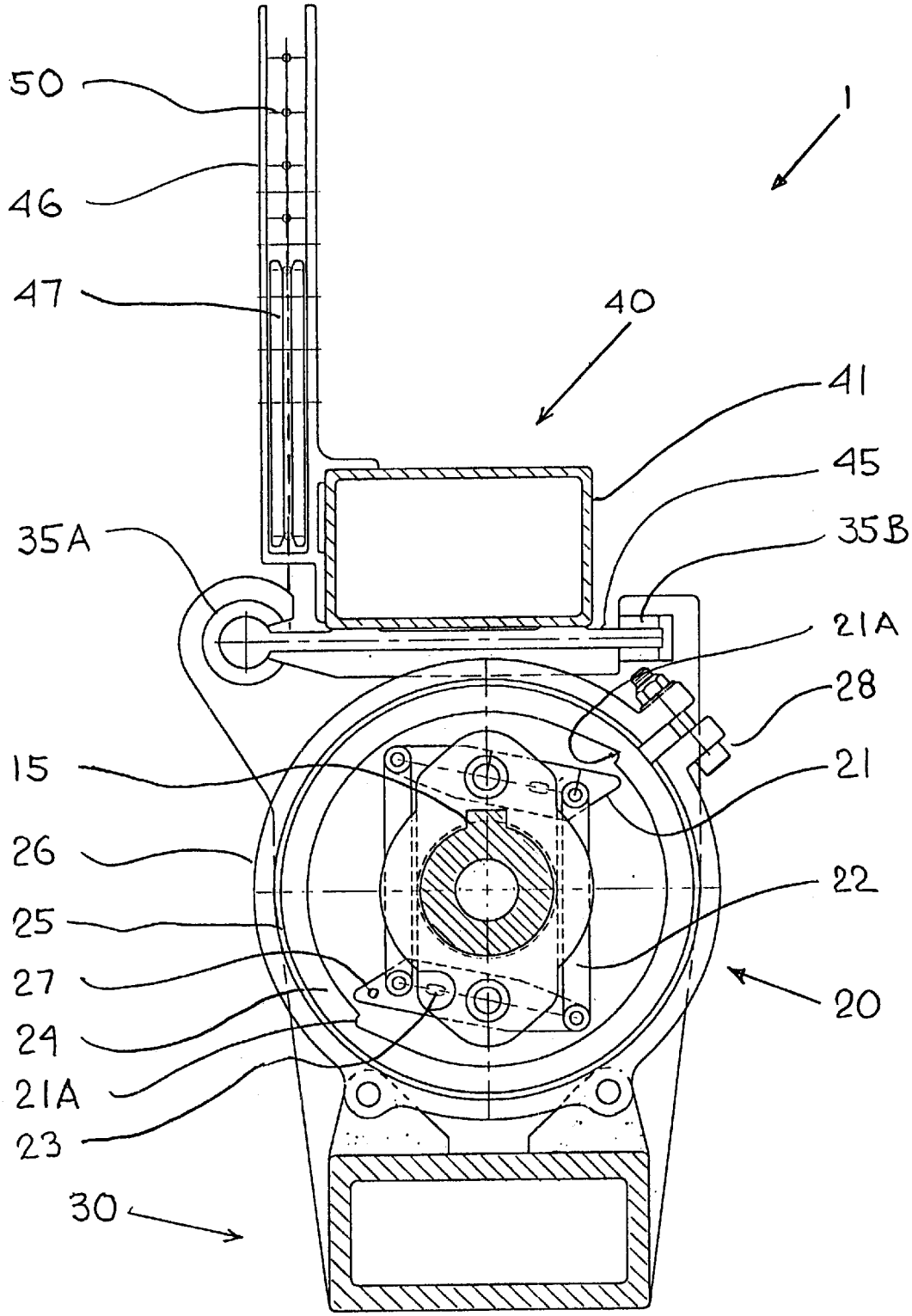
FIG. 3 is a cross sectional view of the winch taken along line 3A—3A of FIG. 1 and FIG. 2 illustrating one form of overspeed brake and sheave and sheave housing mounting on the carriage.

FIG. 3 is a cross sectional view 3A—3A taken on FIG. 1 and FIG. 2 and showing one arrangement of the carriage 40, including frame 41, sheave housing 46, slides 45 and sheaves 47. In this configuration the sheaves and housing are mounted at right angles to frame 41. If horizontal separation of cables 50 is required, the entire winch 1 can be mounted in tilted position. This is easily accomplished by simply rotating the entire winch in a manner similar to that shown in FIG. 4 CCW a small angle about the drum axis, which tilts the multiple sheaves 47 so that they are tilted as shown in FIG. 4 and thus their respective cables 50 horizontally separated when viewed in a plan view from the top of FIG. 3.

Figure 4:
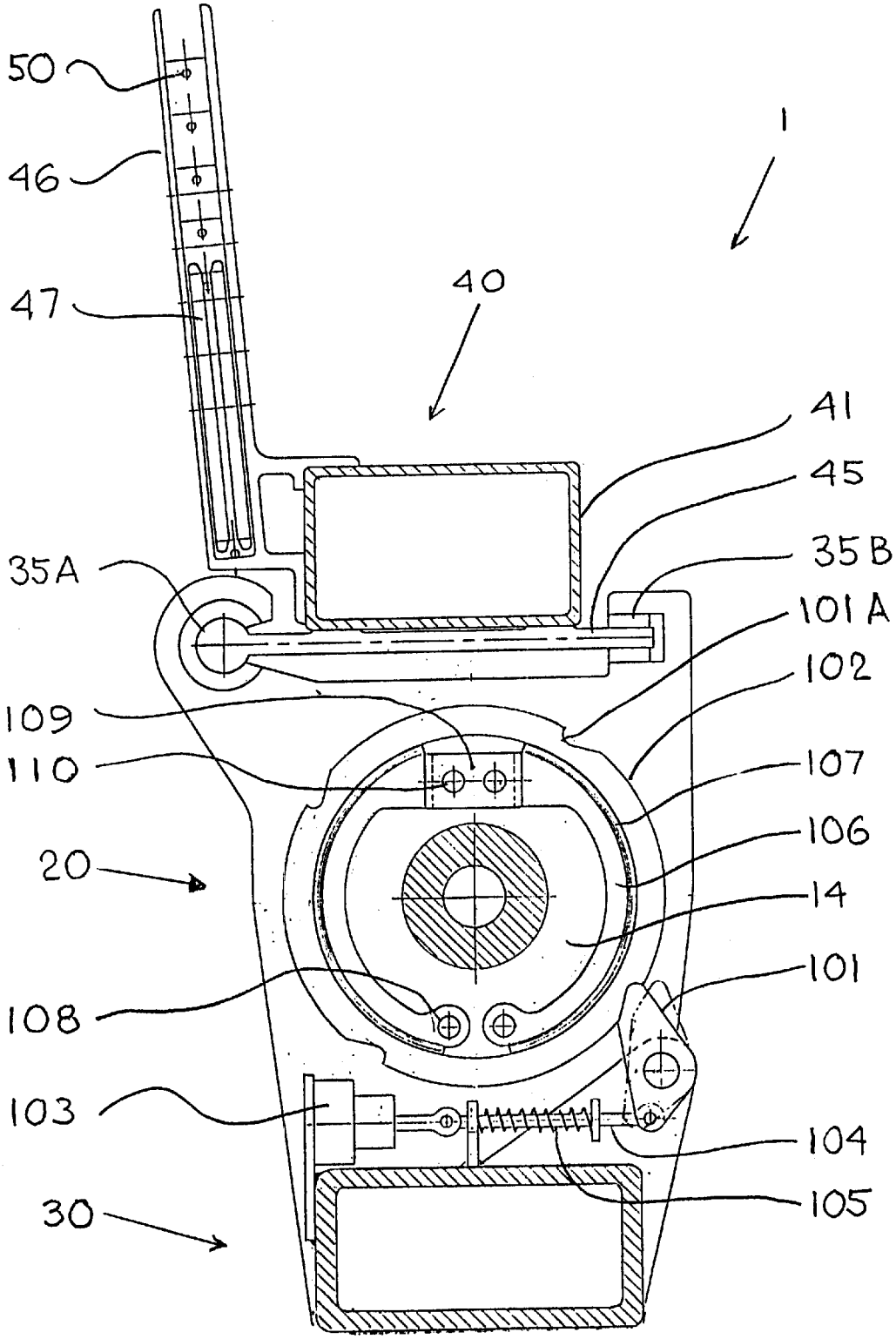
FIG. 4 is a cross sectional view of a winch system similar to that of FIG. 3 illustrating another form, in this case, a drum-type, of overspeed brake and another form of sheave and sheave housing mounting on the carriage.
Figure 5:
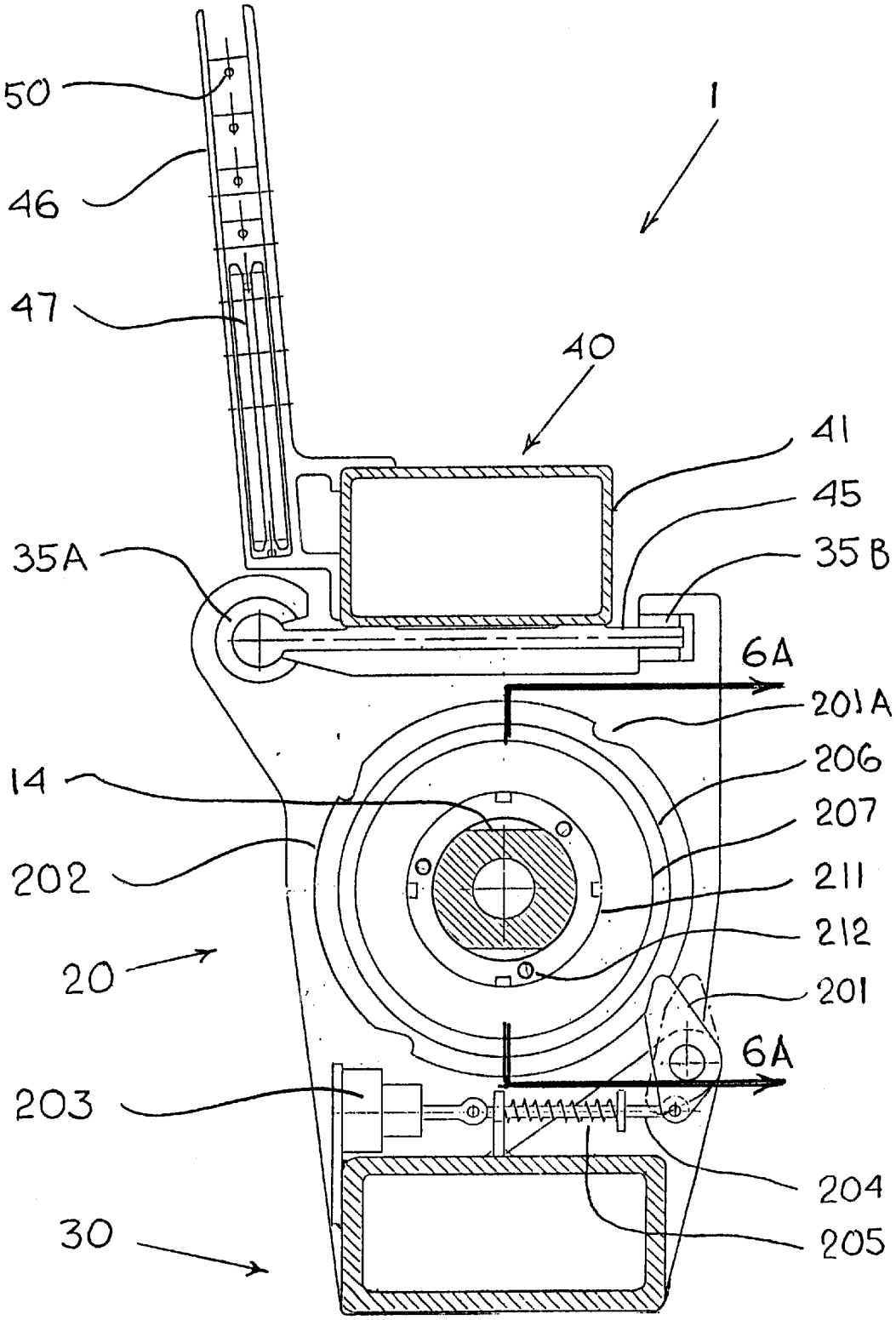
FIG. 5 is a cross sectional view of a winch system similar to that of FIG. 3 illustrating the use of a disc-type overspeed brake.
Figure 11:
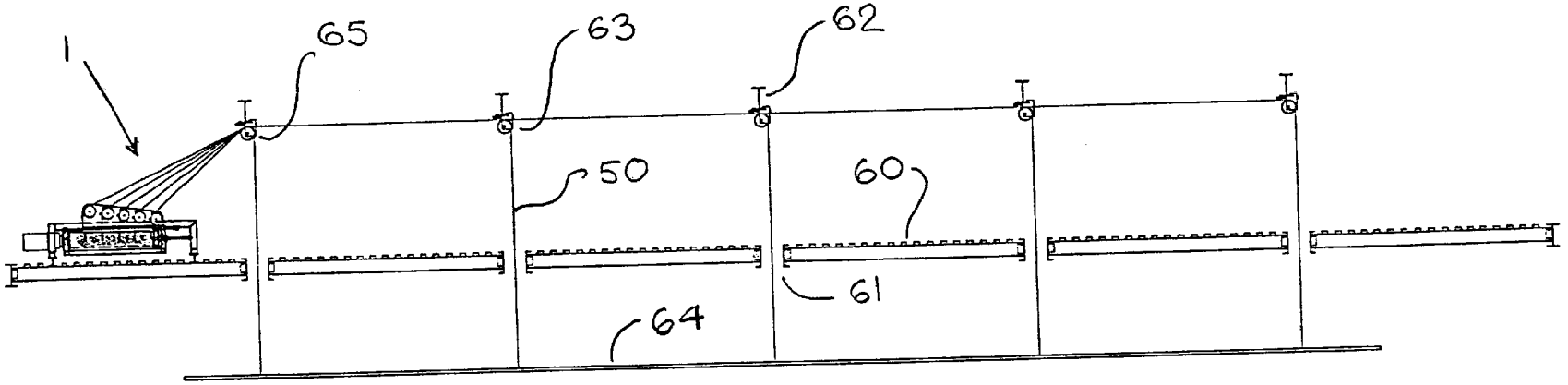
FIG. 11 is a side view of a stage gridiron and fly set with a fly system winch according to the invention mounted on the gridiron or on some other structure at stage right with loftblocks hung from the overhead steel.
Figure 13:
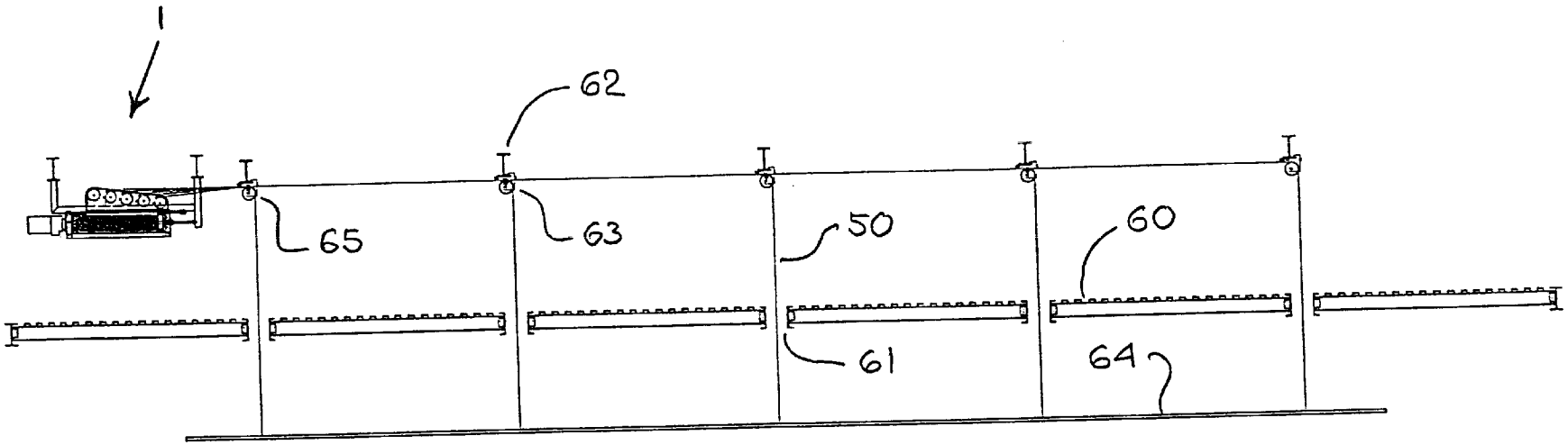
FIG. 13 is a side view of a stage gridiron and fly set with a fly system winch according to the invention mounted below the stagehouse overhead steel at stage right, with loftblocks hung from the overhead steel.
Figure 14:
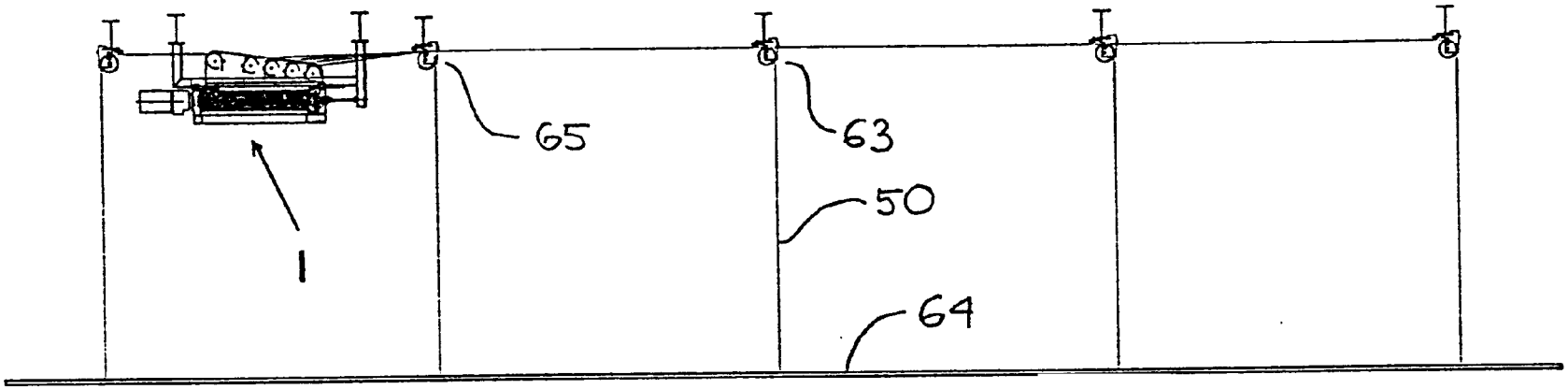
FIG. 14 is a side view of the upper part of a stage house, without gridiron, with a fly system winch according to the invention and loftblocks hung from the overhead steel.

FIG. 4 and FIG. 5 are cross sectional views similar to that of FIG. 3 but showing another possible arrangement of the carriage 40, including frame 41, sheave housing 46, slides 45 and sheaves 47, to horizontally separate the cables. In these configurations, sheaves 47 are mounted in a sloping position with respect to frame 41 and carriage 40. This mounting permits horizontal separation of multiple cables 50 between the sheaves 47 and loftblocks (the horizontal separation in FIG. 11, FIG. 13 and FIG. 14 is in a plane perpendicular to the plane of the drawings in those figures) so that the cables 50 would not rub against the sides of the loft blocks 63, which is accomplished without tilting the base 30 and entire winch.

As shown on FIGS. 1 through 8, the slides 45 are mounted on the carriage 40 horizontal member 41 A. A cylindrical linear bearing 35A, which is self-aligning, engages a cylindrical portion of slide 45. A flat linear bearing 35B engages a flat portion of slide 45. The entire carriage 40 or base 30 (depending on the winch 1 configuration) can be slideably supported, vertically and horizontally, by the two self-aligning linear bearings 35A at opposite ends and vertically by the one flat linear bearing 35B at one of the ends. This is possible, because the base 30 tubular horizontal member 33 provides torque transfer from overspeed brake 20 to base 30 drive end vertical member 32 at the end (left end in FIG. 1) where the flat linear bearing 35B can be installed, because this is where the normal drum assembly 10 driving torque is applied by the motorized gear reducer 37. Since the flat linear bearing 35B is free to move horizontally in FIG. 3, in a direction perpendicular to its travel (in and out of the plane of the drawing of FIG. 3), its use, together with the two self-aligning cylindrical linear bearings 35A, eliminates the need for precise alignment of slides 45. This self-alignment feature derives from the resultant 3-point support of the carriage, which causes the carriage to "float" horizontally and also have a small amount of vertical movement. This is an important feature of the invention. If a second flat linear bearing 35B is used at the base overspeed brake end member 31, its purpose would be secondary safety and it can be fitted over slide 45 with loose tolerances. Stated another way, the cylindrical linear bearing 35A supports the carriage or drum in all directions perpendicular to the drum axis (but not parallel to the drum axis), whereas the flat linear bearing 35B supports the carriage or drum in only one direction perpendicular to the drum axis. So, for example, when the drum is arranged horizontally, the support is in the vertical direction, and when the drum is arranged vertically, the support is in the horizontal direction.

As shown on FIGS. 1–3, FIG. 7, and FIG. 8, as a further feature of the invention, the drum assembly 10 incorporates an overspeed brake 20, with pawls 21, linkages 22, and a release detent 23 installed into the drum 11 brake end cap 14. This eliminates the need for connecting a separate overspeed brake to the drum through shafting and couplings and reduces the size of the assembly and the number of component parts. Incorporating several of the components of the overspeed brake 20 into the drum assembly, which is made possible because of the absence of a separate supporting solid drum shaft, also has the advantage of improving safety. In case of accidental overspeed, the centrifugal force applied on pawls 21 would release the detent 23 and the pawls 21 would engage the notches 21A in a pawl ring 24, thus applying the torque from the rotating drum 11 to the pawl ring 24. The torque is resisted by friction between the pawl ring 24 and a brake lining 25, part of an outer ring 26. The outer ring 26 is connected to and supported by the base 30.

This overspeed brake 20 has features which permit testing the braking torque, verifying the pawls 21 release forces, and adjusting the release detent 23 pressures without removing the brake 20 components or drum 11 from the base 30. Looking at FIG. 2 and FIG. 3, the extended hub of the drum 11 brake end cap 14 has a built in torque test key 15. The pawls 21 have threaded holes 27 for mounting a manual actuation lever. By screwing the actuation lever (not shown) into the mounting hole 27, the pawls 21 can be manually engaged into the pawl ring 24 notches. The motor brake 38 would then be released. A wrench (not shown) can be installed around the extended hub of the drum brake end cap 14 and its key 15. By measuring the force on the wrench, the slipping torque between the brake lining 25 and pawl ring 24 can be determined. The torque can be adjusted by tightening or loosening the torque adjustment screws 28 on the brake outer ring 26. After adjusting the torque, the pawls 21 would be disengaged by use of the manual actuation lever and the lever would then be removed.

Similarly, a lever, screwed into its mounting hole 27 in pawl 21, can be used, together with a force measuring device, for measuring the force required to release the pawls, which force directly relates to the drum 11 rotational speed. The force release can be adjusted by increasing or decreasing the pressure on release detent 23.

While a particular drum type brake is shown on FIG. 3, other drum or disc type brakes can be incorporated into the drum 11 as part of the drum brake end cap 14.

Another drum type overspeed brake is shown in FIG. 4. In this arrangement a single pawl 101 is pivotally mounted on base 30. The pawl 101 is connected to a solenoid 103, through a linkage bar 104. Brake shoes 106 with brake lining 107 are pivotally mounted to the drum 11 brake end cap 14 through pins or shoulder screws 108. The brake shoes 106 can be forced against a pawl ring 102 by a wedge shaped block 109 fastened to the drum brake end cap 14. By tightening screws 110, the sloping ends of the block 109 are forced against the sloping ends of the brake shoes 106 and the brake shoes are forced against the inside face of the pawl ring 109. During a lifting or lowering operation, the solenoid 103 is energized and the pawl 101 is disengaged from notches 101A. The pawl ring 102, brake shoes 106, and block 109 all mounted to the drum 11 brake end cap 14 and are free to rotate with the drum. When the drum rotational overspeed is sensed electronically, electric power is cut from the solenoid 103. The spring 105 forces the pawl 101 against the outer surface of the pawl ring 102, and, when the pawl ring 102 rotates with the drum 11, the pawl 101 will slide, under the force applied by spring 105, into a notch 101A of the pawl ring 102 and stop the rotation of pawl ring 102. The friction between the pawl ring 102 and the brake lining 107 will decelerate and stop the cable drum 11. The amount of friction generated can be adjusted by tightening or loosening the screws 110 forcing the wedge-shaped block 109 against the brake shoes 106. Cams, stiff disc springs or other means can be used instead of the wedge shaped block 109 for forcing the shoe 106 against the pawl ring 102.

The advantages of the type of overspeed brake described in connection with FIG. 4 is that electronic overspeed sensing is accurate and when the solenoid 103 deenergizes, the pawl 104 is always forced against the pawl ring 102 by spring 105. Therefore, when the winch is stopped supporting a load and if the motorized gear reducer 37 or motor brake 38 fails, the drum 111 can only rotate until the pawl 101 engages under spring 105 pressure the notch 101A in the pawl ring 102 for initiating the stopping sequence.

Figure 6:
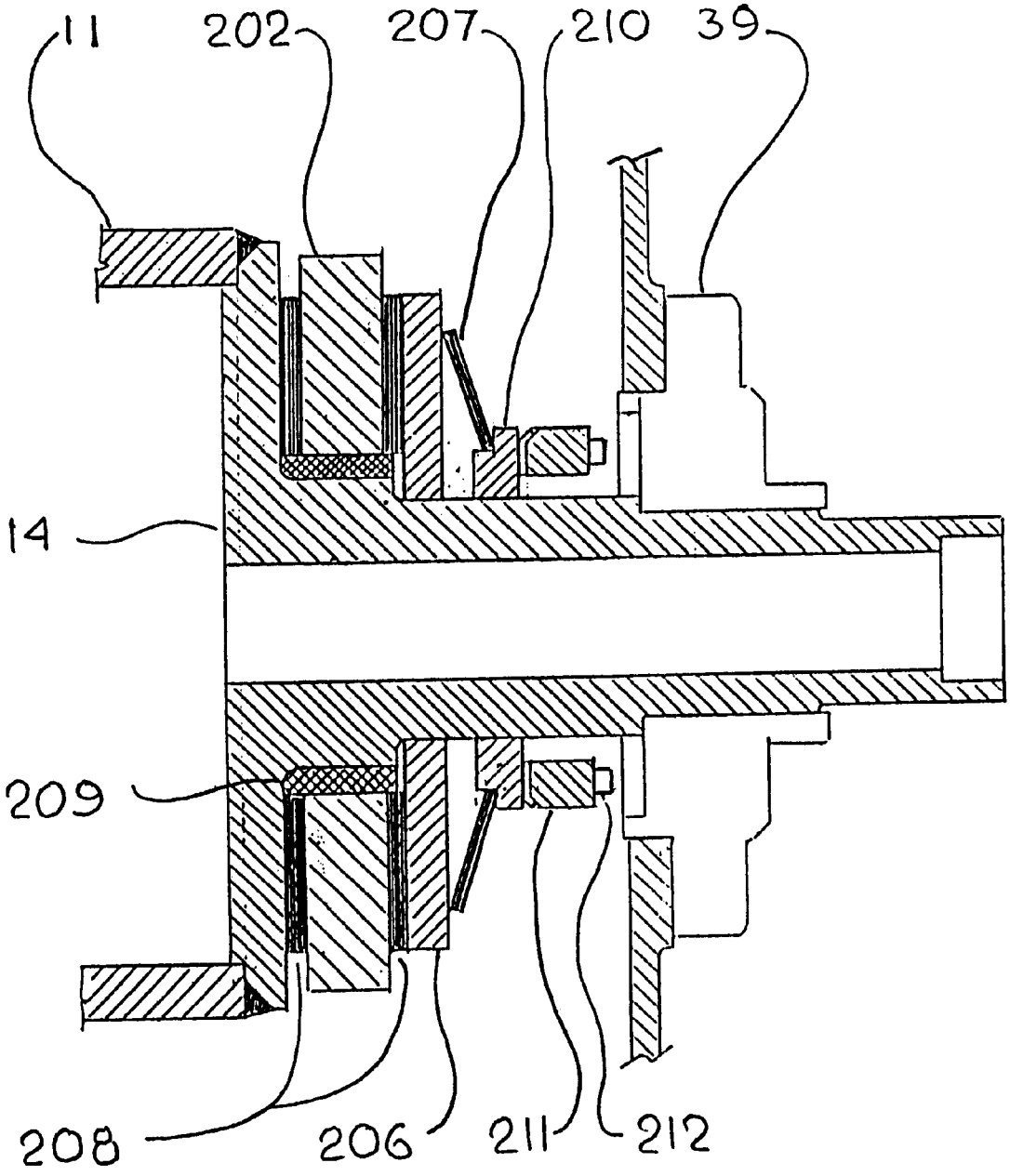
FIG. 6 is a partial cross sectional view taken along the line 6A—6A of FIG. 5 illustrating disc type overspeed brake components.

A disc type overspeed brake modification is shown in FIG. 5 and FIG. 6, which is a partial cross sectional view taken on FIG. 5, along line 6A—6A, limited to showing the drum brake end cap 14, components of overspeed brake 20 and bearing 39. A bushing 209 is pressed on the drum brake end cap 14 hub portion. Friction discs 208 (made of brake lining material) and pawl disc 202 are rotatably mounted, with respect to the drum brake end cap 14, over the bushing 209. A pressure plate 206 is slideably mounted on the drum brake end cap 14 hub portion. The rotation of pressure plate 14 can be prevented by keys, splines or by flattened sides of the drum brake end cap 14 hub portion, as shown in FIG. 5. The pawl disc 202, the friction discs 208, and the pressure plate 206 are forced against each other and against the drum brake end cap 14 by disc spring 207. A disc spring retainer 210 is sldeably mounted on the hub portion of the drum brake end cap 14. Force is applied to all the above components by nut 211 threaded on the drum brake and cap 14 hub portion. The force and the related friction between the drum brake end cap 14, pawl disc 202, pressure plate 206 and friction discs 208 can be adjusted by tightening or loosening the nut 211. Screws 212 can be installed for additional pressure adjustment. During normal raising or lowering, all the above described parts rotate with drum 11. The pawl 201, pivotably mounted on base 30, is held at disengaged position through linkage 204 by solenoid 203, which is also mounted on base 30. When the drum rotational overspeed is sensed electronically, electric power is cut from the solenoid 203. The spring 205 forces the pawl 201 against the pawl disc 202 outer rim. When the pawl disc 202 rotates with the drum 11, pawl 201 will slide, under the force applied by spring 205, into the notch 201A of pawl disc 202 and stop the rotation of pawl disc 202. The friction between the pawl disc 202 and friction discs 208 shall decelerate and stop the rotation of cable drum 11.

The advantages of the disc type overspeed brake shown in FIG. 5 and FIG. 6 are identical to what is described for the drum type brake shown in FIG. 4.

Figure 7:
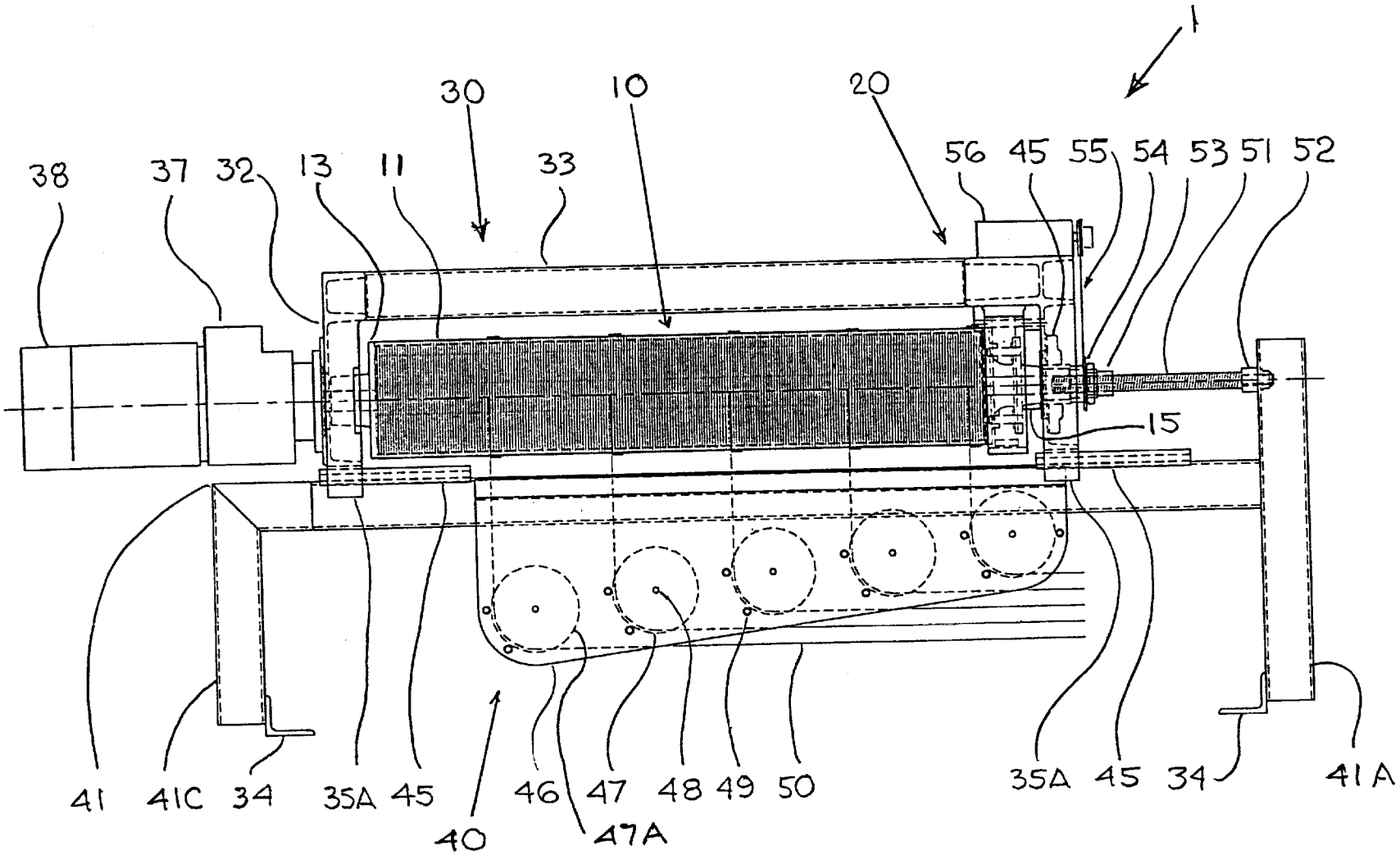
FIG. 7 is a side view of a fly system winch according to the invention, shown in another configuration, with the sheave carriage ready for mounting to the facility structure.

FIG. 7 is a side view of a fly system winch 1 in accordance with the invention in another configuration. In the previous embodiments, the base 30 is fixed, as is the drum horizontally. The carriage 40 and sheave assembly 46 is moved laterally in synchronization with the back and forth travel of the cables 50 in the rotating drum 11 grooves with respect to the base member 30. In this FIG. 7 configuration, the carriage 40 is fastened via legs 34 to the facility structure (not shown) and the entire drum assembly 10, including its base 30 and motorized gear reducer 37, travels horizontally relative to the carriage frame 41, which is fixed to the facility structure, when winding or unwinding of the cables 50. All the parts in this configuration are identical to the parts used for the winch configuration shown in FIG. 1 and FIG. 2, except that the carriage frame 41 is modified. An additional vertical member 41C is added to support the carriage 40. This configuration has a functional advantage, because the horizontal forces from the cables 50 are not applied to the screw 51 as in FIG. 1. In the case of FIG. 7, the only forces applied on the screw 51 are the friction forces between the linear bearings 35A, 35B and slides 45. Furthermore, since the carriage 40 together with sheaves 47 does not move, the cables 50 travel rates and travel distances are not affected by horizontal movement of the carriage 40 of which there is none. This feature permits at least one sheave 47A or more sheaves to be mounted on carriage 46 at the other sides of the vertical cable 50 runs between the drum 11 and sheaves 47, so that these cables lead out from the winch 1 in the opposite direction (to the left as shown on FIGS. 10 and 14). This permits winch 1 to be mounted in between gridiron slots instead of at one side, and eliminates the need for extending the gridiron and stage house to the side stage walls. It also contains all the horizontal rigging loads, applied by nearly horizontal cable runs above the gridiron, within the gridiron structure.

Figure 8:
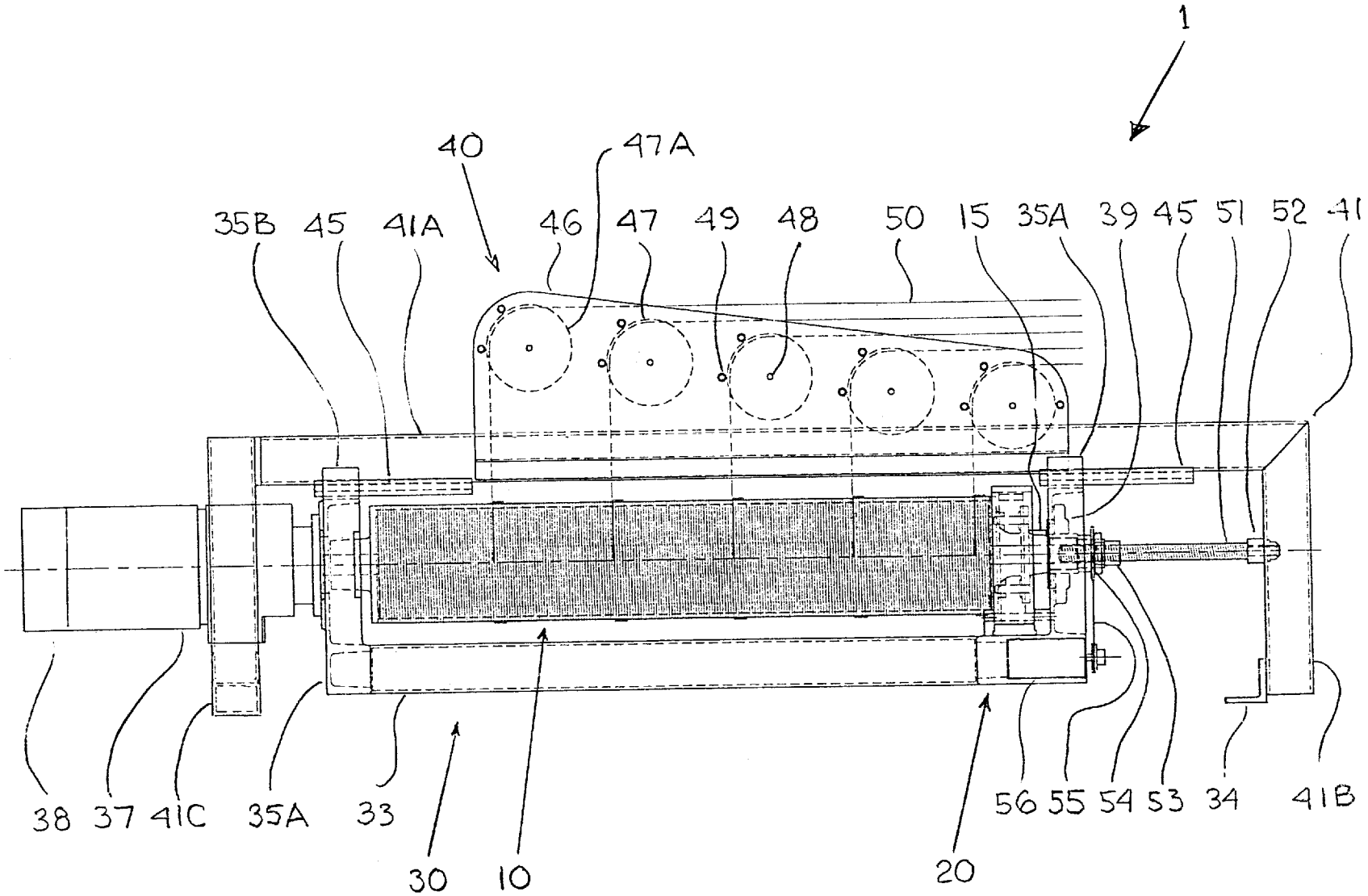
FIG. 8 is a side view of a fly system winch according to the invention, shown in still another configuration, with the sheave carriage ready for mounting to the facility structure. It differs from FIG. 7, because the sheaves are mounted above the carriage.
Figure 12:
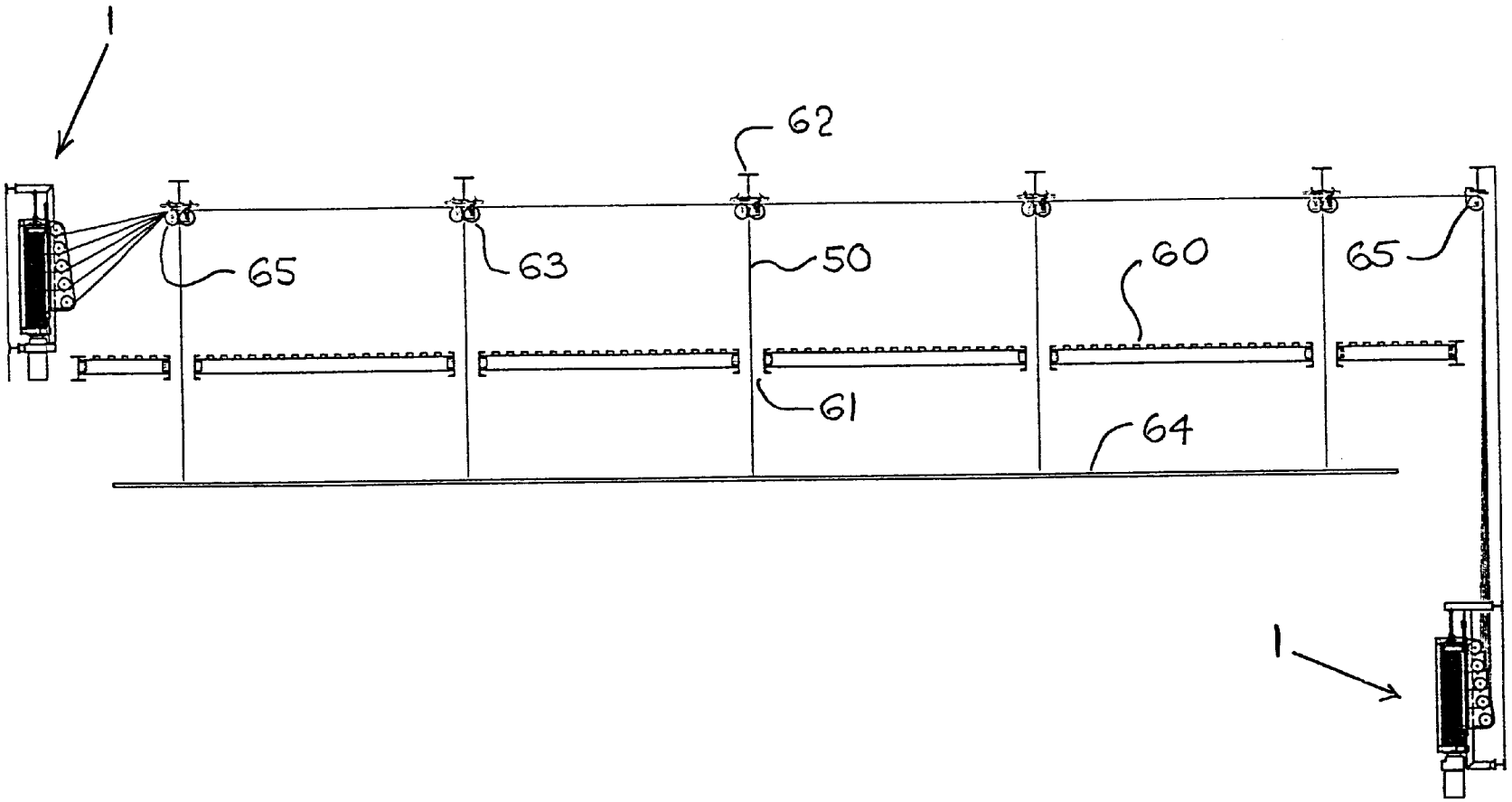
FIG. 12 is a side view of a stage gridiron and fly set with fly system winches accoding to the invention mounted on the stagehouse wall, one above and one below the gridiron, with loftblocks and headblocks hung from the overhead steel.

FIG. 8 is another modification of the winch 1 configuration, similar to that shown in FIG. 7, with the fixed carriage 40 and movable drum assembly 10, except that the sheave housing 46 and sheaves 47 are mounted to the top side of frame 41 horizontal member 41B. With the exception of the modified location of sheave housing 46 and base 30 with respect to carriage 40, the configuration shown in FIG. 8 maintains all the features of the winch configuration shown in FIG. 7. The FIG. 8 configuration also permits angular lead out of cables, as shown in FIG. 11 and FIG. 12, without differential cable velocities.

Based on the features described above, and because the base 30 horizontal member 33 is narrower than drum 11, the fly system winch 1, as shown in FIG. 7 and FIG. 8 can be configured as a spotline winch, using a shorter drum assembly 10 with a single cable leading straight down from the drum 11 or down over an additional sheave to the object to be supported. The single cable leading down would not move horizontally during raising and lowering of the cable-supported object because the drum assembly 10 together with its base 30 travels horizontally in synchronization with the cable winding or unwinding. In this case, the sheave housing 46 and sheaves 47 would not be used on the carriage 40 frame 41. This single configuration would be usable when, for example, the winch is mounted on the gridiron, and the single cable goes straight down (no sheaves needed) through a gridiron well to raise or lower any single object while still providing the screw protection inside the drum. No tooling change would be required for fabrication of components for this modified configuration. Similarly, the cable 50 travel distances can be increased or cables added (or removed) by simply lengthening or shortening the drum 11 tubing 12, together with the base 30 and frame 41 horizontal members 33 and 43 without change of tooling for fabrication of components.

Other fly system winch 1 modifications and derivations are also possible based on the principles outlined above.

The features described herein permit production of several different configurations of the fly system winch 1 with mostly identical parts and with none or only minor tooling changes for weldments. This is especially beneficial for retrofit projects where the fly system winch 1 interfacing conditions vary for many facility structures.

Figure 9:
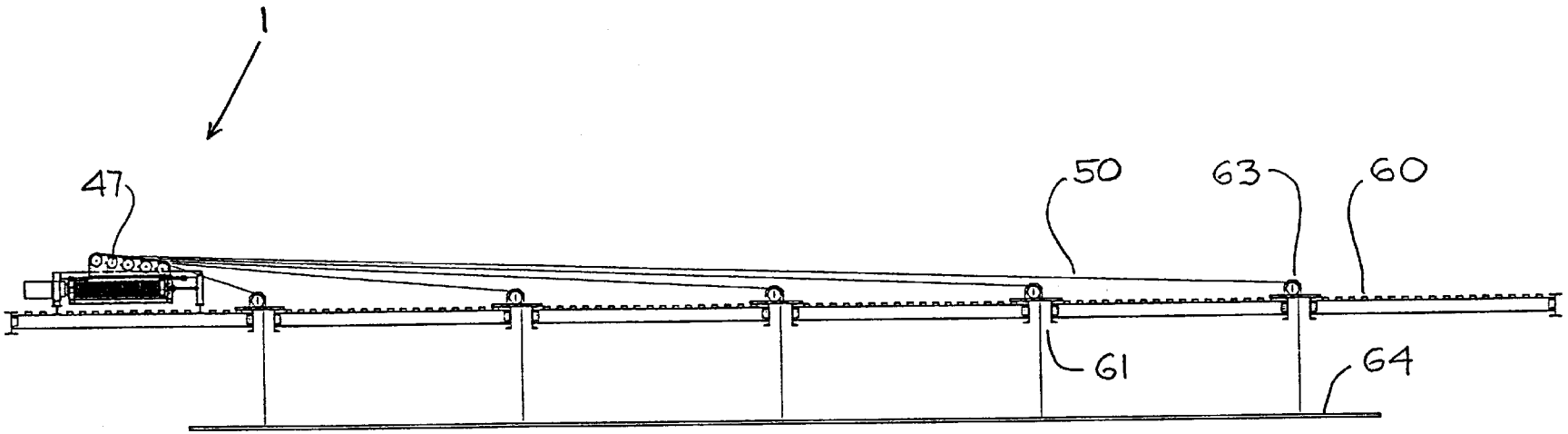
FIG. 9 is a side view of a stage gridiron and fly set with a fly system winch according to the invention mounted on the gridiron and with loftblocks mounted over gridiron wells.

FIG. 9 shows one installation where the fly system winch 1, shown either in FIG. 1 or in FIG. 8, is mounted on the gridiron 60 at stage right. It will be appreciated from the foregoing discussion that it can just as easily be mounted if desired at stage left, or another fly system winch also mounted at stage left. This is also true for the arrangements shown in FIGS. 10, 11, 13 and 14. Cables 50 pass from winch 1 sheaves 47 over loftblocks 63 mounted over the wells 61 of stage gridiron 60 to the pipe batten 64 below from which the scenery is suspended.

Figure 10:
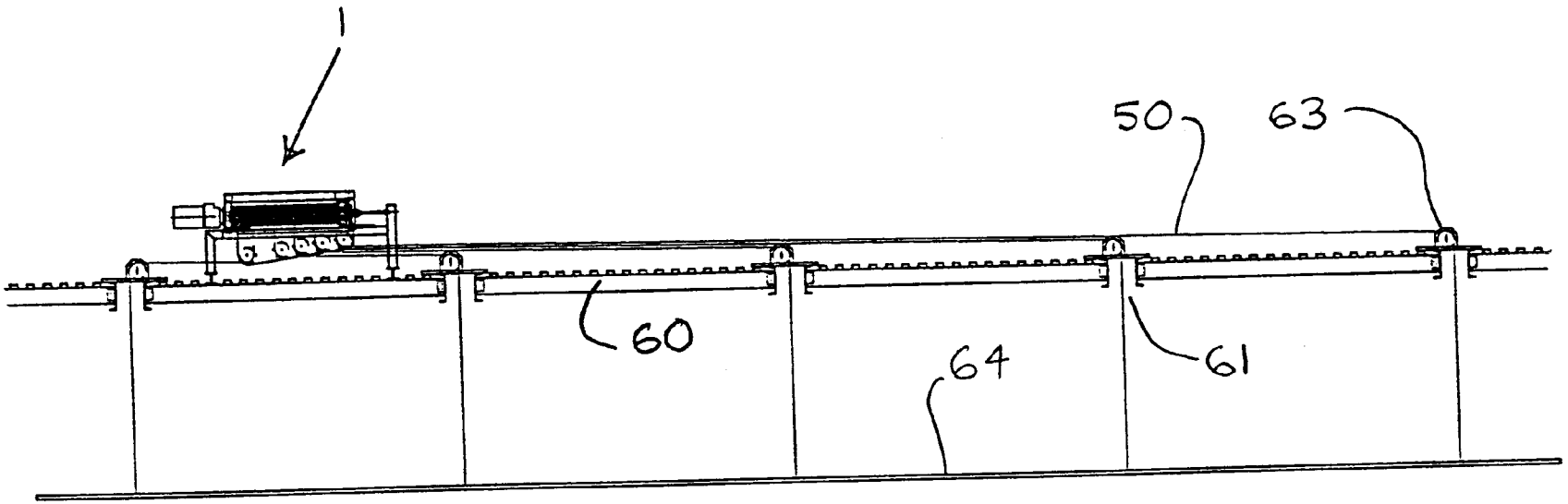
FIG. 10 is a side view of a stage gridiron and fly set with a fly system winch according to the invention mounted on the gridiron in between the loftblocks, with loftblocks mounted over the gridiron wells.

FIG. 10 shows an installation where the fly system winch 1, shown in FIG. 7 or FIG. 8, via its carriage, is mounted on the gridiron 60, in between gridiron wells 61 and loftblocks 63. The cables 50 pass over the loftblocks 63 mounted on gridiron wells 61 and then down to the pipe batten 64. Note that the cables 50 can pass in both lateral directions from the intermediate mounting of the winch 1 between the loftblocks 63. This arrangement is especially practical for installations where there is no space for mounting the winches 1 at stage right, or right outside the area bordered by the grid wells 61. The winch configuration shown on FIG. 1 cannot be placed between the loftblocks 63, because the horizontally moving carriage 40 would cause undesired differential cable travel.

FIG. 11 shows an installation where the fly system winch 1, shown in FIG. 8, is mounted at stage right for use with overhead loftblocks 63. In this case the loftblocks 63 are hung from overhead loftblock beams 62. Cables 50 pass over a multi-line loftblock 65, and one cable drops down from multi-line loftblock 65. The other cables pass over loftblocks 63 and drop down to the pipe batten 64 through the gridiron wells 61. The winch configuration shown in FIG. 1 cannot be used in this case, because diagonal cable leads from the movable carriage 40 would cause undesired differential cable travel.

FIG. 12 shows another installation where fly system winches 1, shown in FIG. 7 and FIG. 8, are mounted on the stagehouse side walls and are used with overhead loftblocks 63. A similar mounting arrangement of winches 1 can be used with grid mounted loftblocks as shown in FIG. 9.

FIG. 13 shows an installation where fly system winches 1 shown in FIG. 1, FIG. 7 or FIG. 8 are mounted to the stagehouse overhead steel for use with underhung loftblocks 63 mounted to the underside of overhead loftblock beams 62. The same mounting arrangement of winch 1 can be used for stages where no gridiron 60 exists. In this case, a multi-line loftblock 65 can be used for horizontal spacing of cables required to clear the sides of loftblocks 63. As an alternative, winch 1 can be tilted or the sheave housing can be tilted as shown in FIG. 4.

FIG. 14 shows an installation where the fly system winch 1 shown in FIG. 7 is mounted to the underside of the stagehouse ceiling beams for installations where a gridiron 60 is not used. In this case, a multi-line loftblock 65 can be used for horizontal spacing of the cables required to clear the sides of loftblocks 63. As an alternative, winch 1 can be tilted or the sheave housing can be tilted as shown in FIG. 4. Note that the cables 50 can pass in both lateral directions from the intermediate mounting of the winch 1 between the loftblocks 63, 65.

Other installation options are possible within the principles of the invention.

Among the benefits of the invention are that the fly system winch is comprised of multifunctional components. This permits reduction of the number of winch component parts, normally used for other fly system winches, without reducing the winch operational functionality in a compact self-contained assembly. As one example, which is not to be considered limiting, for a medium sized theatre, the entire drum assembly and supporting base for one flyset can be reduced to approximately 5 feet in length, which is less than one-half the typical lateral spacing between loftblocks, and will be capable of supplying 4–6 cables approximately 8–12 feet (center line to center line) apart. In a typical theatre installation, by placing the fly system winches on opposite sides of the stage, or in multiple rows on the same side of the stage, the pipe batten front-to-back spacings can be as little as 5½ inches. The fly system winch construction of the invention also utilizes extrusions and castings, made of aluminum or other suitable materials, permitting quality fly system winch construction without excessive tooling requirements and thus at lower cost. Another important advantage is the adaptability of the winch of the invention for a variety of facility interfacing conditions as shown, by use of standardized mounting elements, without the need to change the basic winch components or assemblies. This invention permits the installation of the winches even between the loftblocks, which is not believed possible with other horizontal single-drum type winches. Such an installation option is especially useful in theaters where the off stage gridiron area is limited. In addition, the versatile winch of the invention can be installed in a horizontal position, with its mounting legs below or above the drum, at or adjacent or above or below the gridiron level, or vertically at either side of the stage. Also, it can be installed so that its cable runs are horizontal, vertical or angled. In addition, it can be installed such that the support lines extend laterally in both directions from the winch. This is not believed possible with other known single-drum winch systems. Also, when the drum provides plural support lines for the batten, as here, breakage of one of the lines will not cause the scenery to fall as adequate support will be provided by the other intact lines.

It will also be appreciated that the invention is not limited to raising and lowering scenic elements in a theatre, but can also be used in any facility with a need for raising and lowering any object, such as, for example, objects in a theme park.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A facility and a motorized fly system winch, drum and carriage combination secured to the facility for raising and lowering an object with respect to a stage, a) said facility having plural spaced loftblocks mounted above the stage, b) said motorized fly system comprising:

i) a support carriage and plural cable-guiding devices mounted on said carriage, ii) a base member having first and second end portions, iii) an elongated hollow drum having grooves and having a longitudinal axis and rotatably mounted on the base member and plural cables for simultaneously winding and unwinding the cables on or off the drum grooves when the drum is rotated, said cables passing from the outside of the drum over the cable-guiding devices to the spaced loftblocks, respectively, for supporting an object such that rotation of the drum causes the object to move down and up with respect to the stage, iv) first means for slideably mounting the base member to the carriage, v) said drum having at a first end a hollow hub rotatably journalled at the first end of the base member, vi) second means for rotating the drum relative to the carriage such that the base member with its drum and the carriage can move with respect to each other in synchronism with the rotation of the drum to control the cable runs to their respective cable-guiding devices, vii) a screw axially aligned with the hollow hub and the hollow drum and connected to the drum and non-rotatably connected to the carriage such that the screw extends outside of the hollow drum when the object is in a down or up position and moves through the hollow hub into the hollow drum when the drum is rotated to move the object to its up or down position, respectively.

2. A facility and a motorized fly system winch, drum and carriage combination secured to the facility for raising and lowering an object as set forth in claim 1, further comprising a gridiron, the loftblocks are mounted along the gridiron and the motorized fly system is mounted on and at one side of the gridiron.

3. A facility and a motorized fly system winch, drum and carriage combination secured to the facility for raising and lowering an object as set forth in claim 1, further comprising a gridiron, the loftblocks being mounted along the gridiron and the carriage of the motorized fly system being mounted on the gridiron between the loftblocks, some of the cables passing toward one side of the gridiron, others of the cables passing toward the opposite side of the gridiron.

4. A facility and a motorized fly system winch, drum and carriage combination secured to the facility for raising and lowering an object as set forth in claim 3, further comprising a gridiron, the loftblocks being mounted above the gridiron and the carriage of the motorized fly system being mounted on and at one side of the gridiron, the cables angling upward from the cable-guiding means to the loftblocks.

5. A facility and a motorized fly system winch, drum and carriage combination secured to the facility for raising and lowering an object as set forth in claim 1, further comprising a gridiron, the loftblocks being mounted above the gridiron and the motorized fly system being mounted on the facility spaced from the gridiron.

6. A facility and a motorized fly system winch, drum and carriage combination secured to the facility for raising and lowering an object as set forth in claim 1, wherein the facility has a ceiling above the stage, the loftblocks are mounted at the stage ceiling and the motorized fly system is mounted on the facility ceiling spaced from the gridiron.

7. A facility and a motorized fly system winch, drum and carriage combination secured to the facility for raising and lowering an object as set forth in claim 1, wherein the facility has a ceiling, the loftblocks are mounted along the ceiling and the carriage of the motorized fly system is mounted on the ceiling between the loftblocks, some of the cables passing toward one side of the ceiling, others of the cables passing toward the opposite side of the ceiling.

8. A facility and a motorized fly system winch, drum and carriage combination secured to the facility for raising and lowering an object as set forth in claim 1, further comprising a gridiron mounted over the stage, the overall length of the motorized fly system winch, drum and carriage combination being much smaller than the width of the gridiron.

9. A facility and a motorized fly system winch, drum and carriage combination secured to the facility for raising and lowering an object as set forth in claim 8, wherein the overall length of the motorized fly system winch, drum and carriage combination is smaller than about one-half the spacing between the loftblocks.

10. A motorized fly system winch, drum and carriage combination for raising and lowering objects, comprising:

a) a support carriage and at least one cable-guiding device mounted on said carriage, b) a base member having first and second end portions, c) an elongated drum having grooves rotatably mounted on the base member and at least one cable for winding and unwinding the cable on or off the drum grooves when the drum is rotated, said cable passing from the drum over the cable-guiding device for supporting a object such that rotation of the drum causes the object to move up and down, d) first means for slideably mounting the base member to the carriage such that the base member with its drum and the carriage can move with respect to each other in synchronism with the rotation of the drum to control the cable run to the cable-guiding device, e) said first means for slideably mounting comprising second means at the first end portion of the base member for supporting the base member in all directions perpendicular to the drum axis, and third means at the second end portion of the base member for supporting the base member in one direction perpendicular to the drum axis for self-alignment of the base member and the carriage.

11. A motorized fly system winch, drum and carriage combination for raising and lowering objects as set forth in claim 10, wherein the second means and third means combine to provide a 3-point slideable linear bearing support of the base member to the carriage.

12. A motorized fly system winch, drum and carriage combination for raising and lowering objects as set forth in claim 10, wherein the second means provides two points of linear bearing support of the base member to the carriage one at the first and the other at the second end portions of the drum and the third means provides one point of linear bearing support of the base member to the carriage at the second end portion of the drum.

13. A motorized fly system winch, drum and carriage combination for raising and lowering objects as set forth in claim 12, wherein the second means comprises a first cylindrical linear bearing at the first end portion of the drum and a second cylindrical linear bearing at the second end portion of the drum and both cylindrical linear bearings being at the same side of the base member, and the third means provides a flat linear bearing at the second end portion of the drum at the side of the base member opposite to that of the first and second cylindrical linear bearings.

14. A motorized fly system winch, drum and carriage combination for raising and lowering objects as set forth in claim 13, further comprising driving means at the second end portion of the base member and directly connected to the drum for rotating the drum and overspeed braking means at the first end portion of the base member.

15. A motorized fly system winch, drum and carriage combination for raising and lowering objects as set forth in claim 10, wherein the drum contains plural cables and the carriage comprises plural spaced cable-guiding means each for guiding one of the cables to the object.

16. A motorized fly system winch, drum and carriage combination for raising and lowering objects, comprising:

a) a support carriage and at least one cable-guiding device mounted on said carriage, b) a base member having first and second end portions, c) an elongated drum rotatably mounted on the base member and at least one cable for winding and unwinding the cable on or off the drum when the drum is rotated, said cable passing from the drum over the cable-guiding device for supporting an object such that rotation of the drum causes the object to move up and down, d) first means for slideably mounting the base member to the carriage such that the base member with its drum and the carriage can move with respect to each other in synchronism with the rotation of the drum to control the cable run to the object, e) said drum having at a first end a hollow hub rotatably journalled at the first end portion of the base member, f) an overspeed brake located in part within the hollow hub leaving a vacant center space and operative to brake the drum with respect to the base member in response to its rotation velocity exceeding a predetermined value.

17. A motorized fly system winch, drum and carriage combination for raising and lowering objects as set forth in claim 16, further comprising means for testing the performance of the overspeed brake incorporated in part within the hollow hub, said means for testing allowing testing of the overspeed brake's performance without removing same from the hollow hub.

18. A motorized fly system winch, drum and carriage combination for raising and lowering objects as set forth in claim 16, wherein the overspeed brake comprises pawls on the hub and rotatable with the drum and a torque-resisting ring connected to the base member and surrounding the pawls, said pawls being operative in response to centrigugal forces to engage the torque-resisting ring when the drum's velocity exceeds a predetermined value.

19. A motorized fly system winch, drum and carriage combination for raising and lowering objects as set forth in claim 16, wherein the overspeed brake comprises at least one pawl on the base member and a torque-resisting ring rotatable with the drum and radially spaced from the pawl, said pawl being operative in response to an electrical signal generated when the drum's velocity exceeds a predetermined value to engage the torque-resisting ring.

20. A motorized fly system winch, drum and carriage combination for raising and lowering objects as set forth in claim 16, wherein the overspeed brake comprises at least one pawl on the base member and a torque-resisting disc in frictional engagement with the drum and rotatable with the drum and radially spaced from the pawl, said pawl being operative in response to an electrical signal generated when the drum's velocity exceeds a predetermined value to engage the torque-resisting disc stopping its rotation and forcing the drum to stop rotating.

21. A motorized fly system winch, drum and carriage combination for raising and lowering scenery, comprising:

a) a support carriage and plural cable-guiding devices mounted on said carriage, b) a base member having first and second end portions, c) an elongated hollow drum having cable grooves and having a longitudinal axis and rotatably mounted on the base member and plural cables for simultaneously winding and unwinding the cables on or off the drum grooves when the drum is rotated, said cables passing from the outside of the drum over, respectively, the cable-guiding devices for supporting scenery such that rotation of the drum causes the scenery to move up and down, d) first means for slideably mounting the base member to the carriage, e) said drum having at a first end a hollow hub rotatably journalled at the first end portion of the base member, f) second means for rotating the drum relative to the base member such that the base member with its drum and the carriage can move with respect to each other in synchronism with the rotation of the drum to control the cable runs to the plural cable-guiding devices, respectively, g) said second means comprising an elongated screw having a first end non-rotatably mounted to the carriage and a second end threadingly engaging a like threaded member non-rotatably connected to the drum and axially aligned with the hollow hub and the hollow drum, said screw extending mainly outside of the hollow drum when the cables are wound up on or unwound from the drum and the scenery is in its respective up or down position, h) said hollow hub and hollow drum being sized such that the screw can move into the hollow hub to allow the hollow drum to receive the screw as the cables unwind from or wind up on the drum as the scenery moves to its respective down or up position.

22. A motorized fly system winch, drum and carriage combination for raising and lowering scenery as set forth in claim 21, wherein the scenery has a storage position and the screw is positioned inside the hollow drum when the scenery is in its storage position.

23. A motorized fly system winch, drum and carriage combination for raising and lowering scenery as set forth in claim 21, wherein the drum surface is grooved to receive the cables, the drum grooves have a certain pitch, and the pitch of the screw thread is the same as that of the drum grooves.

24. A motorized fly system winch, drum and carriage combination for raising and lowering scenery inside a theatre as set forth in claim 21, further comprising third means for mounting the fly system winch, drum and carriage combination to the theatre.

25. A motorized fly system winch, drum and carriage combination for raising and lowering scenery as set forth in claim 24, wherein the third means are secured to the base member.

26. A motorized fly system winch, drum and carriage combination for raising and lowering scenery as set forth in claim 24, wherein the third means are secured to the carriage.

27. A motorized fly system winch, drum and carriage combination for raising and lowering an object, comprising:

a) a carriage, b) a base member having first and second end portions, c) an elongated hollow drum having cable grooves and having a longitudinal axis and rotatably mounted on the base member and a cable for simultaneously winding and unwinding the cable on or off the drum grooves when the drum is rotated, said cable passing from the outside of the drum directly or via a sheave to the object such that rotation of the drum causes the object to move up and down, d) first means for slideably mounting the base member to the carriage, e) said drum having at a first end a hollow hub rotatably journalled at the first end portion of the base member, f) second means for rotating the drum relative to the base member such that the base member with its drum and the carriage can move with respect to each other in synchronism with the rotation of the drum to control the cable run to the object, g) said second means comprising an elongated screw having a first end non-rotatably mounted to the carriage and a second end connected to the drum and axially aligned with the hollow hub and the hollow drum, said screw extending mainly outside of the hollow drum when the cable is wound up on or unwound from the drum and the object is in its respective up or down position, h) said hollow hub and hollow drum being sized such that the screw can move into the hollow hub to allow the hollow drum to receive the screw as the cable unwinds from or winds up on the drum as the object moves to its respective down or up position.

28. A motorized fly system winch, drum and carriage combination for raising and lowering an object as claimed in claim 27, further comprising a facility, said carriage being mounted to the facility.

29. A motorized fly system winch, drum and carriage combination for raising and lowering an object as claimed in claim 27, further comprising:

i) third means for slideably mounting the base member to the carriage, j) third means for slideably mounting comprising fourth means at the first end portion of the base member for supporting the base member in all directions perpendicular to the drum axis, and fifth means at the second end portion of the base member for supporting the base member in one direction perpendicular to the drum axis for self-alignment of the base member and the carriage.

30. A motorized fly system winch, drum and carriage combination for raising and lowering an object as claimed in claim 27, further comprising:

i) an overspeed brake located in part within the hollow hub leaving a vacant center space and operative to brake the drum with respect to the base member in response to its rotation velocity exceeding a predetermined value.

31. A motorized fly system winch, drum and carriage combination for raising and lowering objects, comprising:

a) a support carriage and at least one cable-guiding device mounted on said carriage, b) a base member having first and second end portions, c) an elongated drum rotatably mounted on the base member and at least one cable for winding and unwinding the cable on or off the drum when the drum is rotated, said cable passing from the drum over the cable-guiding device for supporting an object such that rotation of the drum causes the object to move up and down, d) first means for rotating the drum relative to the carriage, said first means also functioning as a primary holding brake for the drum and its object, e) second means for slideably mounting the base member to the carriage such that the base member with its drum and the carriage can move with respect to each other in synchronism with the rotation of the drum to control the cable run to the object, f) said drum having at a first end a hollow hub rotatably journalled at the first end portion of the base member, g) an overspeed secondary holding brake mounted on the drum and located in part within the hollow hub leaving a vacant center space and operative to brake the drum with respect to the base member in response to its rotation velocity exceeding an unsafe value.

32. A motorized fly system winch, drum and carriage combination for raising and lowering objects as claimed in claim 31, wherein the secondary holding brake comprises pawls and frictional surfaces to effect the braking action.

33. A motorized fly system winch, drum and carriage combination for raising and lowering objects as claimed in claim 32, wherein means are provided for activating the pawls to effect a braking action in response to centrifugal force or an electrical impulse generated by a rotation velocity sensor.

* * * * *